US006719190B2

(12) United States Patent
Yocum

(10) Patent No.: US 6,719,190 B2
(45) Date of Patent: Apr. 13, 2004

(54) FOOD CARTON HAVING CYLINDRICAL LOWER PORTION

(75) Inventor: James A. Yocum, West Chester, PA (US)

(73) Assignee: Dopaco, Inc., Exton, PA (US)

( * ) Notice: Subject to any disclaimer, the term of this patent is extended or adjusted under 35 U.S.C. 154(b) by 0 days.

(21) Appl. No.: 10/013,959

(22) Filed: Dec. 13, 2001

(65) Prior Publication Data

US 2002/0084319 A1 Jul. 4, 2002

Related U.S. Application Data

(60) Provisional application No. 60/254,933, filed on Dec. 13, 2000.

(51) Int. Cl.[7] ..... B65D 3/04; B65D 5/36

(52) U.S. Cl. ..... 229/104; 229/117.03; 229/117.06; 229/405; 229/906

(58) Field of Search ..... 229/4.5, 104, 117, 229/117.03, 117.06, 400, 405, 902, 906

(56) References Cited

U.S. PATENT DOCUMENTS 3,912,331 A * 10/1975 Turner et al. ..... 229/4.5
4,109,848 A * 8/1978 Kipp et al. ..... 229/104
4,210,271 A * 7/1980 Dutcher ..... 229/400
4,267,955 A * 5/1981 Struble ..... 229/117.03
4,552,293 A * 11/1985 Blagg et al. ..... 229/400
6,053,403 A * 4/2000 Cai ..... 229/400
6,182,890 B1 * 2/2001 Sattler et al. ..... 229/104
2002/0014524 A1 * 2/2002 Willis ..... 229/400

* cited by examiner

*Primary Examiner*—Gary E. Elkins
(74) *Attorney, Agent, or Firm*—Dennison, Schultz, Dougherty & MacDonald

(57) ABSTRACT

A finger food container formed as a flat carton expandable into a truncated conical configuration with a substantially cylindrical lower portion extending upward to a scoop-forming upper portion. Front and rear walls of the folded carton have lower edges interconnected by a bottom wall which, upon an outward bowing of the front and rear walls, expands therebetween in close conformance thereto for a locking of the front and rear walls in the outwardly bowed positions thereof.

17 Claims, 4 Drawing Sheets

FOOD CARTON HAVING CYLINDRICAL LOWER PORTION

CROSS REFERENCE TO RELATED APPLICATIONS

This application claims the benefit of the U.S. Provisional Patent Application No. 60/254,933 filed on Dec. 13, 2000, entitled "Collapsible Food Carton Having Cylindrical Lower Portion," the contents of which are incorporated herein by reference.

TECHNICAL FIELD

The present invention is directed toward a food carton, and more specifically, toward a flat glued food carton which, when erected, has a rounded or generally cylindrical lower portion adapted to fit into a vehicle cup holder.

BACKGROUND OF THE INVENTION

French fries, onion rings, and similar fast food products (hereinafter referred to generally as "finger foods" or "foods") that can be eaten with one's fingers are popular restaurant carry-out items. Not infrequently, these foods are eaten in an automobile by the consumer away from the restaurant, often along with other food items, such as hamburgers and beverages.

Most automobiles, in order to accommodate containers for such foodstuffs are provided with one or more cup holders. Such cup holders have traditionally been used to accommodate beverage cups and bottles with cylindrical lower portions.

However, a problem arises with regard to how best to accommodate conventional finger food cartons which, when filled, are generally of an oval or scoop-like configuration with an oval or oblong lower portion not readily accommodatable within the conventional vehicle cup holder. Thus, if the driver of the vehicle wishes to avail himself of the finger food, there is no convenient way to hold the carton, or any convenient place to put the carton, the only options available being either to continuously hold the carton in one hand or lay the carton down on an adjacent seat, tray portion, or the like.

This problem could be addressed by serving the finger food in conventional beverage cups. However, such cups, normally including rolled rigidifying upper rims and water-tight sealed bottoms, neither of which are required for finger food containers, are substantially more expensive than the conventional scoop carton for many reasons including the use of thinner materials in scoop cartons and the ease with which such cartons can be formed as flat items for both shipping and storage economies. It is also to be recognized that the conventional scoop configuration of the upper portion of a scoop carton provides significant advantages in simplifying the filling of the carton.

Some attempts have been made to produce food cartons with cylindrical lower portions. This has resulted in two types of containers, a first type wherein a pre-formed container is utilized. Such containers are formed as a fully erected container at the time of manufacture, somewhat similar to a drinking cup. Note commonly assigned U.S. Pat. No. 6,053,403, issued Apr. 25, 2000, to Liming Cai. Such containers, while suited for their intended purpose, cannot be collapsed and must be shipped and stored in a stacked, nested state. Thus, such formed cartons tend to be more expensive and less practical from a commercial standpoint.

A second proposal has involved the development of folded food cartons which open to form a generally rectangular or rounded lower portion. However, these cartons also have encountered various problems. For example, such cartons often have undesirably large gaps between their bottom and side walls, which gaps tend to allow small food items to fall from the container. Some attempts to minimize the size of the openings between the bottom and side walls have involved providing a bottom wall formed with multiple layers of paperboard material or a bottom wall of a complex array of cut lines, fold lines and perforations. Thus, such cartons also tend to be too expensive to produce economically, and in some instances are difficult to erect. It should be appreciated, in this regard, that such cartons are throw-away items which are used by the thousands. Thus, even small economies can be significant.

SUMMARY OF THE INVENTION

The present invention is concerned with the provision of an improved finger food carton which incorporates the advantages of flat-formed cartons with regard to shipping and storage, as well as economies in manufacture, while at the same time, significantly improving thereon in providing for accommodation of the filled carton within conventional vehicle cup holders and the like. In conjunction therewith, the carton of the invention, while flat-formed and expandable in a convenient manner, incorporates a unique bottom or bottom wall construction which minimizes gapping, stabilizes the lower portion of the carton in a generally cylindrical configuration, and is easily expanded from the original folded position thereof to its position in the erected carton.

Basically, the carton includes, as manufactured and prior to opening into its use position, overlying front and rear tapered side walls interconnected at the lower or base ends thereof by a centrally folding bottom or bottom wall. The wall relationship is such whereby an inward pressure on the opposed tapered upright or vertical edges of the front and rear walls will produce an outward bowing of these walls relative to each other to define an upwardly directed conical or scoop configuration. As this occurs, the depending centrally folded bottom wall upwardly flexes between the lower edge portions of the side walls into a slight upward convex configuration which locks the walls in the open position of the carton. The bottom wall is so peripherally configured as to retain the lower edge portions of the side walls in a rounded or substantially cylindrical configuration adapted for reception within a cup holder. The side walls in turn, upward from the cylindrical lower portion thereof, and in light of the line joined vertical edges thereof, tends to broaden transversely into a general scoop configuration at the upper portion of the container to thus retain the scoop features of known fry containers along with the advantages of the cup-shaped lower portion.

The bottom wall is specifically configured to close the bottom of the open carton in a manner which not only ensures the stability of the open carton, but also minimizes any gaps therein. In this regard, the overall configuration of the bottom is such as to force and retain the lower peripheral edge portion of the two side walls into a substantially circular configuration. Pursuant thereto, the bottom includes, in addition to the transverse center fold, a second central fold line perpendicular thereto and extending between opposed end edges of the bottom which integrally join the front and rear side walls respectively along fold lines. The side edges of the bottom wall are each formed by a pair of linear lengths or extents which converge outwardly from corresponding ends of the end edges of the bottom wall to an apex on the transverse fold line, forming what might generally be referred to as an angular convex side edge. Each of these side edges, and an arcuate segment of the bottom wall adjacent thereto, tends to flex as the bottom wall moves into its open position, through engagement of the corresponding outer side edges of the bottom wall with the side edge portions of the front and rear walls, flexing slightly downward relative to the upwardly moving bottom wall to encourage a more intimate engagement with the side wall and to reduce any gapping therebetween. To enhance this flexing and more specifically define the arcuate segments, an arcuate fold line can be provided in the bottom wall inwardly spaced from each side edge and generally parallel to the corresponding side edges.

While the preferred embodiment of the carton utilizes a blank wherein the front and rear wall panels are positioned in the blank with the lower or base wall edges in parallel slightly spaced relation with the single ply integral bottom wall panel interposed therebetween, as a second embodiment, the carton can be formed utilizes a blank wherein the front and rear wall panels are integrally joined inside-by-side relation with a single fold line therebetween and utilizing a single glue flap. In such a blank, the bottom wall will be formed of two partially overlapped plies, one integral with the lower edge of each side wall panel.

Other objects, features and details of the invention will become apparent from the following more complete description of the invention.

BRIEF DESCRIPTION OF DRAWINGS

The present invention will now be described, by way of example, with reference to the accompanying drawings, in which.

DETAILED DESCRIPTION OF THE INVENTION

Figure 1:
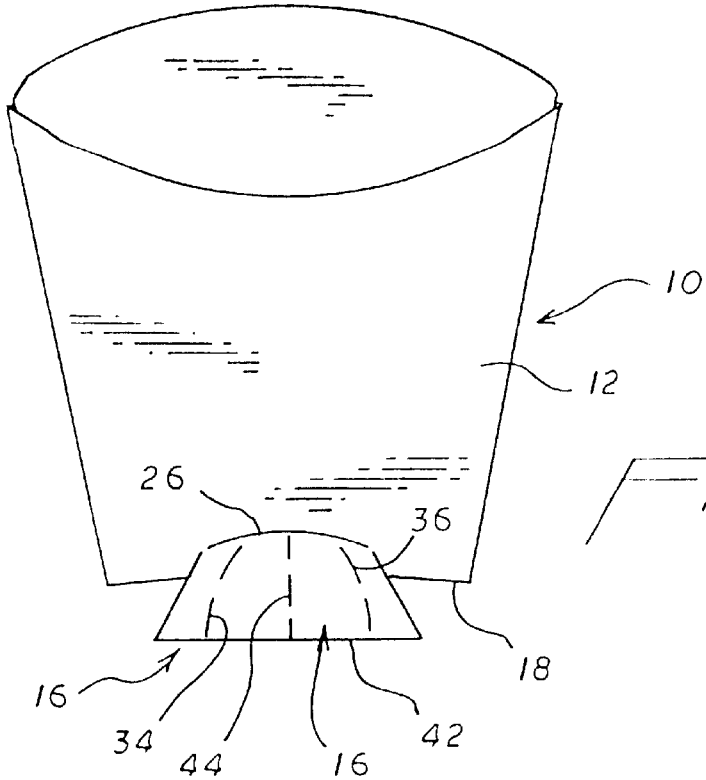
FIG. 1 is a front elevational view of a food carton according to the present invention in its flat formed collapsed and storage configuration.

Referring now more specifically to the drawings, wherein the showings are for purposes of illustrating preferred embodiments of the invention only and not for the purpose of limiting same, FIG. 1 shows a food carton generally designated at 10. Broadly, food carton 10 is assembled by folding and gluing a unitary blank 15, shown in FIG. 6, which is cut out of a sheet of appropriate shape sustaining foldable material such as paperboard stock. To facilitate the description of the present invention, the food carton will be generally described in an orientation in which it is normally used by a consumer, which is with the opening for the food at the top.

Figure 2:
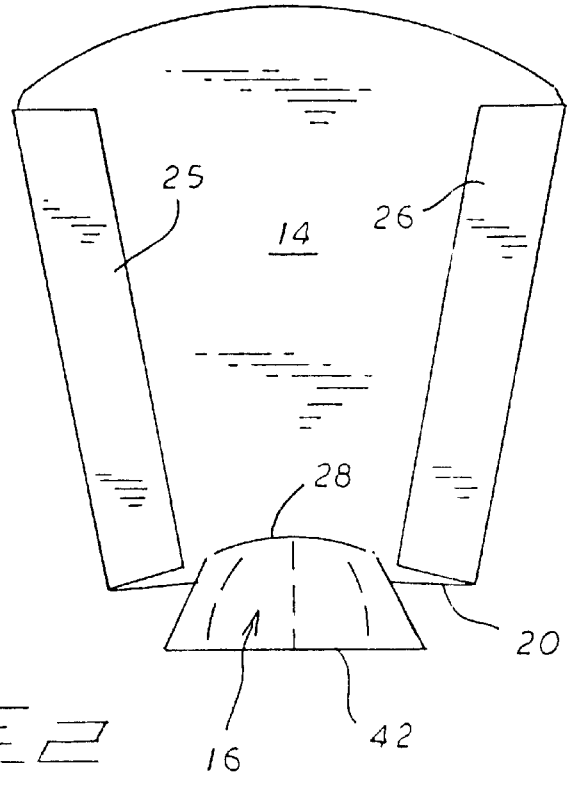
FIG. 2 is a rear elevational view of the flat food carton of FIG. 1.
Figure 3:
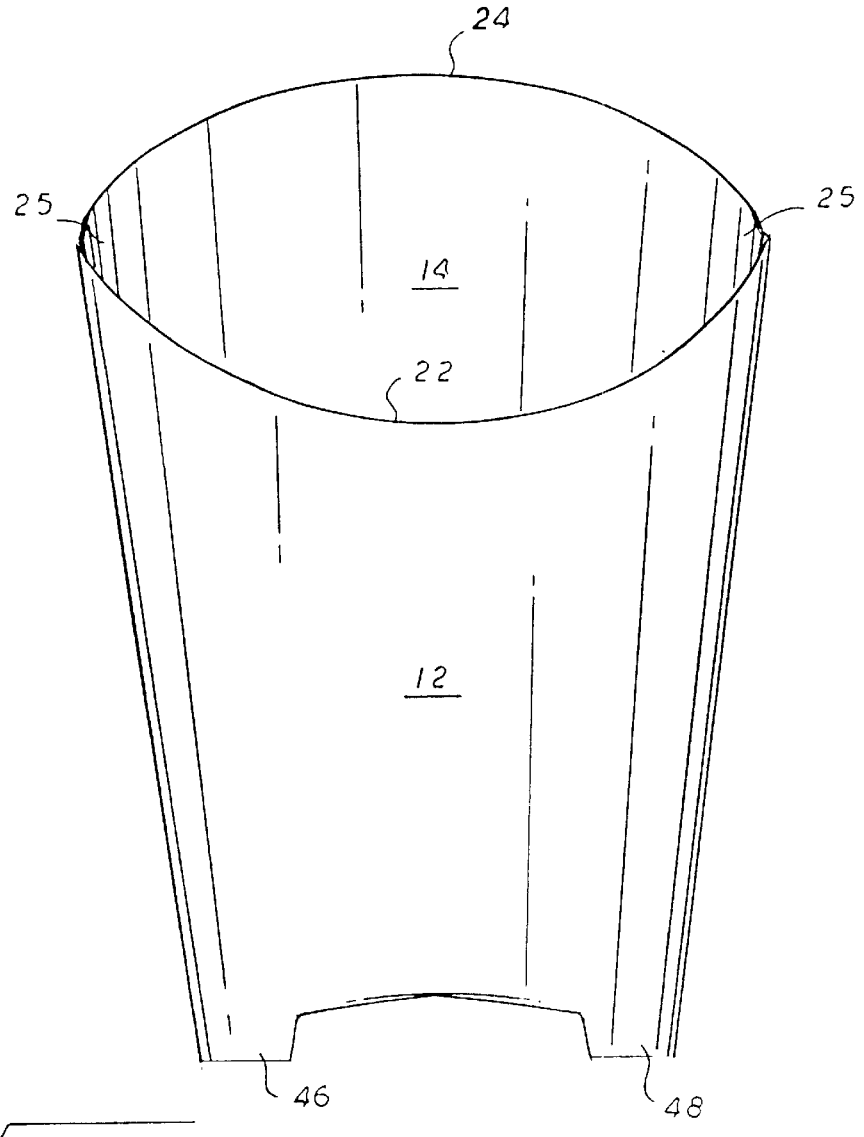
FIG. 3 is a front elevational view of the food carton of FIG. 1 in its erected use configuration.
Figure 4:
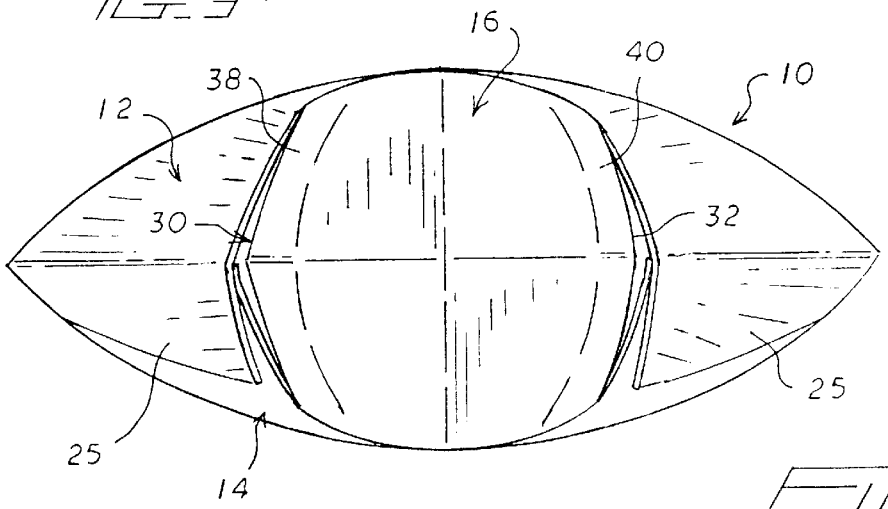
FIG. 4 is a bottom plan view of the food carton of FIG. 3.

The carton 10, noting both its folded position in FIGS. 1 and 2, and its in-use configuration in FIGS. 3 and 4, includes a front wall 12 and a rear wall 14 with a bottom wall 16 integral with and extending transversely between the lower portions of the front and rear walls 12 and 14. This relationship will possibly be best seen in the blank 15 illustrated in FIG. 6 wherein the front and rear wall panels 12 and 14 are aligned along the longitudinal axis of the blank with the corresponding lower or base edges 18 and 20 thereof in spaced parallel relation to each other and with the bottom wall panel 16 integrally joined to the lower portions of the wall panels 12 and 14 and extending longitudinally therebetween. As will be seen, the front, rear and bottom wall panels of the blank 15 are designated by the same reference numbers as the carton walls which they form in the manufactured carton 10.

The front and rear panels 12 and 14 are each of a generally truncated triangular configuration having opposed side edges diverging upward from the corresponding base edge 18 or 20 and terminating in a transverse upper or outer edge. The transverse outer edge 22 on the front wall panel 12 is concave while the corresponding transverse outer edge 24 on the rear wall panel 14 is convex, thereby providing, in the erected carton, the desired scoop configuration. The front and rear walls 12 and 14 of the carton are joined utilizing a pair of glue flaps 25 integral with the front wall panel 12 along the side edges thereof. These flaps, in an obvious manner, will fold about the side edge portions of the rear wall 14 and bond to the outer face of the rear wall. Note, for example, FIG. 2.

The concavity of the upper edge 22 of the front wall 12 and the convex configuration of the upper edge 24 of the rear wall 14 generally complement each other as a manufacturing expedient and, in the use or unfolded position of the carton 10, define a preferred scoop configuration at the open end of the carton while the lower portion of the open carton is of the desired generally circular configuration as shall be explained subsequently.

Figure 6:
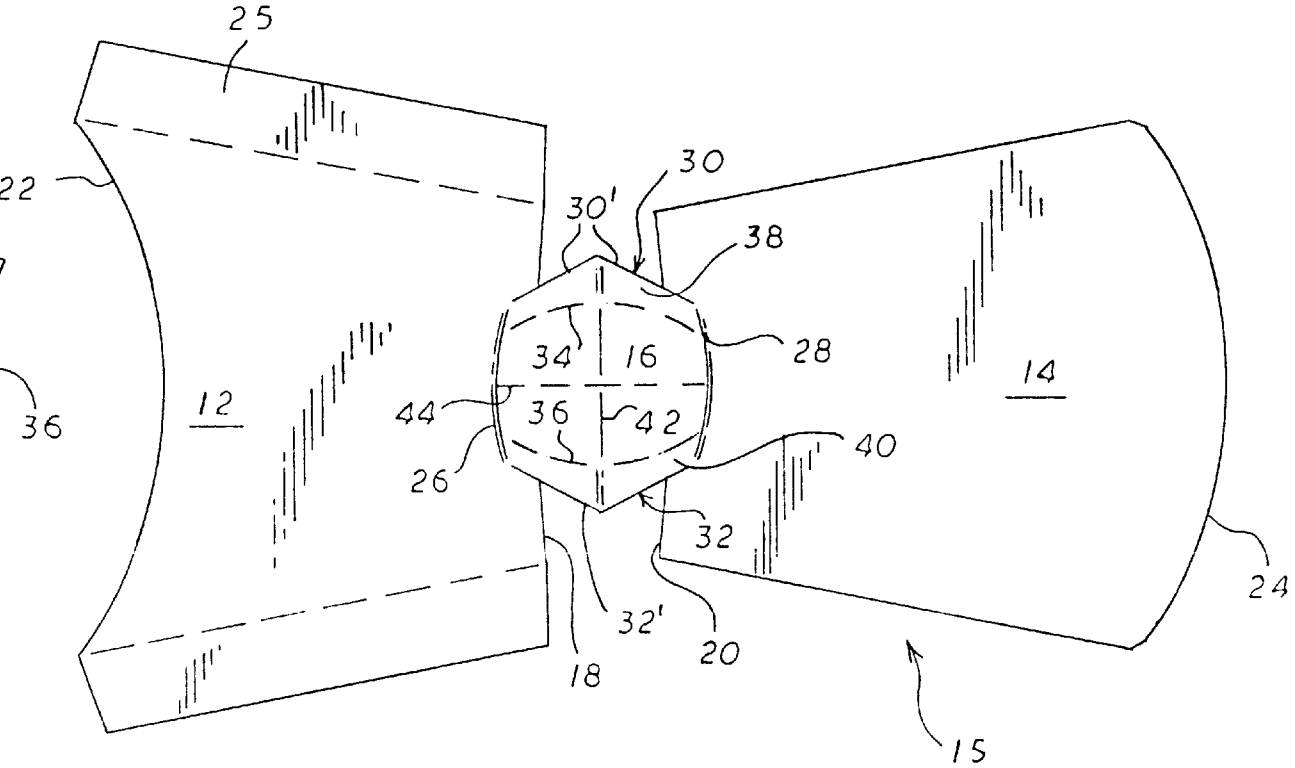
FIG. 6 is a top plan view of a blank for forming the food carton of FIG. 1.

As noted best in FIG. 6, the bottom wall panel 16 is of a generally hexagonal configuration with opposed end edges 26 and 28 integral with the front and rear wall panels 12 and 14 along arcuate fold lines inwardly offset from the respective lower edges 18 and 20 of the side wall panels. The bottom panel 16 is further defined by space opposed side edges 30 and 32 extending between corresponding ends of the bottom panel end edges 26 and 28. Each side wall edge comprises a pair of edge lengths or extents 30' or 32' angularly diverging from each other from a midpoint between the end edges 26 and 28 to the corresponding ends of the edges 26 and 28. It will be noted that the edge lengths 30' and 32' actually extend, by cut lines, into the opposed lower portions of the front and rear wall panels 12 and 14 to extend to the inwardly offset bottom panel end edges 26 and 28.

The angular extent of each side edge 30 and 32 defines a generally convex configuration. As desired, arcuate fold lines 34 and 36, respectively inwardly spaced and generally paralleling the angular side edges 30 and 32, may also be provided transversely between the bottom end edges 26 and 28 to define generally arcuate side sections or segments 38 and 40 on the bottom wall panel 16. The bottom wall panel is completed by a first transverse central line 42 along the maximum transverse width of the bottom panel centrally between the bottom panel end edges 26 and 28, and a second center fold line 44 perpendicular to the fold line 42 centrally between the formed arcuate segments 38 and 40.

As will be appreciated from FIGS. 1 and 2, in the folded carton with the front and rear walls in overlying relation, the bottom wall 16 is folded about the transverse centerline 42, defining a pair of overlapping bottom wall sections of generally trapezoidal configuration, the maximum width of which, defined at the center fold line 42, is less than the length of the lower edges 18 and 20 of the front and rear walls.

When the folded carton is to be opened for reception of the foodstuff, the opposed vertical edges of the folded carton are inwardly compressed toward each other. This in turn causes a corresponding outward bulging of the front and rear walls 12 and 14 relative to each other and a corresponding unfolding of the bottom wall 16 with the extent of the outward bowing of the front and rear walls 12 and 14 being such as to cause an upward movement of the central portion of the bottom wall, along transverse fold line 42, to a slight upwardly offset position wherein the bottom wall is slightly upwardly convex. If necessary, this positioning of the bottom wall can be encouraged by a slight finger pressure upward thereagainst.

Figure 5:
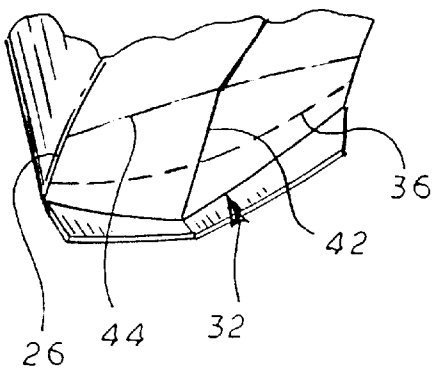
FIG. 5 is a bottom perspective detail of a side portion of the bottom wall and the adjoining side walls.

The dimensions of the bottom wall 16, that is the width along central fold line 42 and the width transverse thereto along fold line 44, are such as to shape the front and rear wall lower edges 18 and 20 into a substantially circular configuration, along with the lower wall portions immediately above these lower edges. At the same time, the bottom wall side edge segments 38 and 40, adjacent edges 30 and 32 and whether or not defined by the arcuate fold lines 34 and 36, flex and closely conform to the now arcuate side edge portions of the opened front and rear walls, note in particular FIGS. 4 and 5. The bottom wall segments 38 and 40, through at least partial engagement of the outer angular edges 30 and 32 thereof with the inner surfaces of the surrounding front and rear walls 12 and 14, are caused to slightly downward flex to both enhance supporting engagement with the front and rear walls and minimize any tendency for gaps to occur therebetween.

Inasmuch as the bottom wall 16, in the erected carton of FIG. 3, is actually positioned upward of the lower edges 18 and 20 of the front and rear walls, a pair of opposed stabilizing support feet 46 and 48 are formed. Further, the upward offsetting of the bottom wall 16 from the extreme lower edge of the formed carton, sufficiently extends the desired cylindrical configuration, formed by the bottom wall, to provide a depth to this cylindrical portion sufficient for proper reception within a conventional vehicle cup holder. At the same time, inasmuch as the outward flexing of the front and rear walls is unsupported upwardly spaced from the bottom wall, the open cartons will tend to assume the desired oblong configuration which facilitates the desired scooping action in filling the container and also allows ready access to the finger food therein by the consumer.

Figure 7:
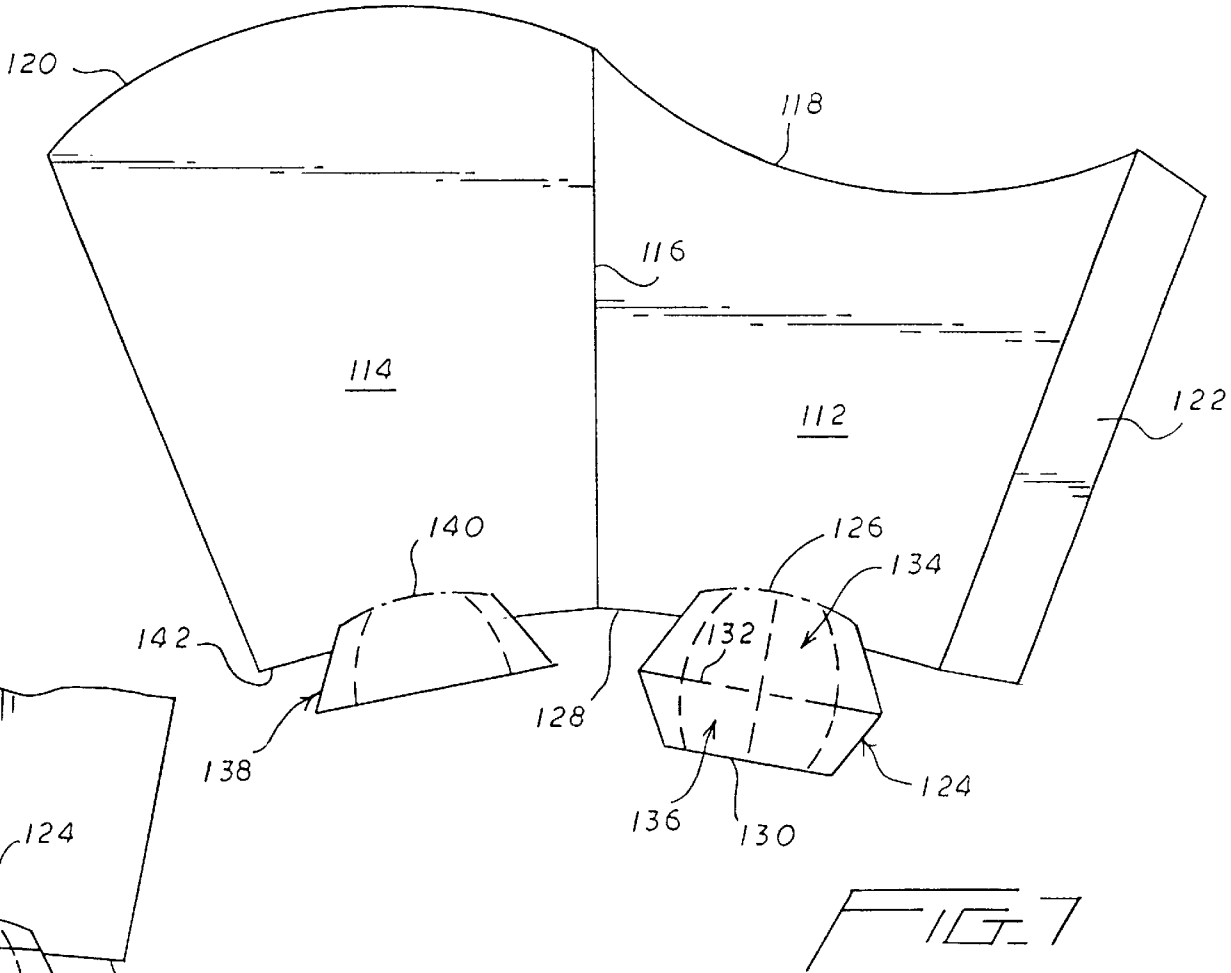
FIG. 7 is a top plan view of a blank for forming a food carton according to second embodiment of the invention.
Figure 8:
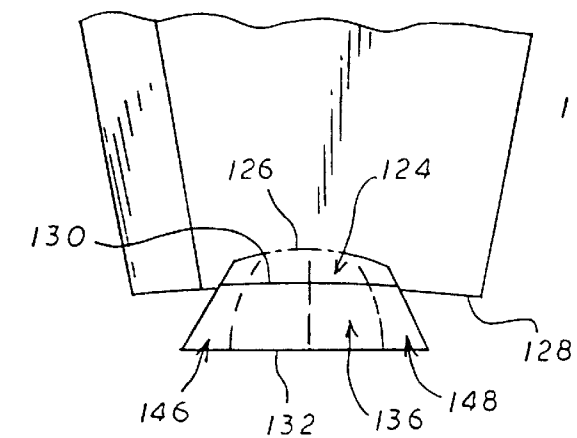
FIG. 8 is an elevational detail of the lower portion of the folded blank of FIG. 7 with the bottom wall portions bonded.

Referring now to FIGS. 7 and 8, a further embodiment of the carton of the invention is illustrated therein utilizing a blank wherein the front and rear walls or wall forming panels 112 and 114 are laterally adjacent each other with fold line 116 defined along the common edge therebetween. As in the first embodiment, the front wall 112 is provided with a concave upper edge 118 which complements the convex upper edge 120 of the rear wall 114. A single glue flap 122 extends integrally along the single outer edge of the front wall 112 and, upon a folding of the front and rear walls into an overlying relation with each other, overlies and is adhesively bonded to the outer face of the rear wall 114.

The bottom wall to be defined by this blank comprises a first bottom wall section 124 integral with the lower portion of the front wall panel 112 along an arcuate fold line 126 inwardly offset from the lower edge 128 of this wall and differing from the one-piece bottom wall panel 16 of the first embodiment only in that the section 124 is truncated and terminates relative to bottom panel 16 in a straight edge 130 paralleling the lower edge 128 of the outer wall panel 112. This bottom wall section 124 includes a transverse fold line 132 along the maximum width of the section and dividing the bottom wall section 124 in an upper portion 134 and a lower portion or extension 136. The upper portion 134, above the fold line 132, is dimensionally equal to one-half of the bottom panel 16 of the first embodiment to one side of the transfer fold line 42 thereof. The portion 136 below the fold line 132 is, as previously suggested, truncated and terminates in the outer linear edge 130.

A second bottom wall section 138 is integrally formed with the lower edge portion of the rear wall panel 114 along an arcuate fold line 140 inwardly spaced from the lower edge 142 of this rear wall panel 114. This section 138 duplicates the upper portion 134 of the first bottom wall section 124 and, upon a folding of the blank to define the folded carton, overlaps the truncated lower portion 136 of the first bottom panel section 124 and aligns along the transverse fold line 132 thereof as will be seen in the partial elevational view of the folded carton in FIG. 8. The two bottom sections 124 and 138 form a bottom wall which, other than being partially multi-layered, duplicates the bottom wall 16 of the first embodiment, including opposed arcuate foldable side segments 146 and 148 which duplicate the foldable side segments of the bottom wall 16. So formed, it will be appreciated that the folded carton of the invention adapts itself to formation from blanks of different basic configurations, allowing for a versatility which permits use of differing manufacturing techniques. As will be recognized, manipulation of the formed folded carton of the embodiment of FIGS. 7 and 8 will be as described with regard to the first embodiment, with particular reliance placed on the arcuate bottom wall edge segments to enhance the stability of the open carton, encourage the desired cylindrical configuration, and minimize any gapping appearing therein.

The subject invention has been described herein in terms of preferred embodiments. It is to be appreciated that such additions and/or modifications which may be evident to those skilled in the art are intended to fall within the scope of the invention as claimed.

I claim:

1. A food carton of an inverted truncated generally conical configuration comprising front and rear walls, each wall having a bottom edge, a top edge and opposed side edges diverging upward from said bottom edge to said top edge, the side edges of each of said front and rear walls being foldably joined to the corresponding side edges on the other of said front and rear walls, said front and rear walls, in a first folded configuration of the carton, being in flat parallel overlying relation to each other, said front and rear walls, in a second erected use configuration, each having an outward bow relative to the other and between the opposed side edges thereof, and a bottom wall extending between and having opposed ends edges foldably joined to the front and rear walls in closely spaced relation above the lower edges thereof, said bottom wall, in the second use configuration, forcibly retaining said outwardly bowed front and rear walls in a slightly tapering substantially cylindrical configuration along at least a lower extent of said carton upward from the lower edges of said front and rear walls, wherein said outward bow of said front and rear walls in said use configuration gradually decreases upward between said substantially cylindrical lower extent to the upper edges of said front and rear walls, wherein said bottom wall comprises the sole means retaining said front and rear walls in said second use configuration, and wherein said bottom wall includes opposed side edges extending between the end edges thereof and between the lower edges of said front and rear walls, said bottom wall side edges each being generally convex, and a pair of arcuate fold lines defined in said bottom wall, one fold line in inwardly spaced generally parallel relation to each bottom wall side edge to define therewith an arcuate foldable segment along each side edge of the bottom wall.

2. The food carton of claim 1 wherein the opposed end edges of said bottom wall are convex.

3. The food carton of claim 2 wherein the opposed side edges of said bottom wall are each defined by two linear extents diverging at an angle from each other at a midpoint between said bottom wall end edge.

4. The food carton of claim 3 including a central fold line in said bottom wall and extending between the midpoints of the bottom wall side edges.

5. The carton of claim 4 including a second central fold line defined in said bottom wall perpendicular to the first central fold line and extending between said end edges of said bottom wall.

6. The carton of claim 5 wherein said bottom wall includes two partially overlapped sections, one integrally joined to each of said front and rear walls along a corresponding one of said bottom wall end edges.

7. The carton of claim 4 wherein a first bottom wall section corresponds to said bottom wall to one side of the first central fold line, and a second bottom wall section includes a portion corresponding to said bottom wall to the other side of the first central fold line, and an extension on said portion underlying and bonded to said first bottom wall section with said first section and said portion of said section meeting at said first central fold line.

8. The carton of claim 1 wherein said bottom wall includes opposed side edges extending between the end edges thereof and between the lower edges of said front and rear walls, said bottom wall side edges each being generally convex, and a pair of arcuate fold lines defined in said bottom wall, one fold line in inwardly spaced generally parallel relation to each bottom wall side edge to define therewith an arcuate foldable segment along each side edge of the bottom wall, said segments being folded to conform the bottom wall side edges to said front and rear wall inner surfaces in the second erected use configuration of said front and rear walls.

9. The carton of claim 8 wherein the opposed side edges of said bottom wall are each defined by two linear extents diverging at an angle from each other at a midpoint between said bottom wall end edge.

10. The carton of claim 9 including a central fold line in said bottom wall and extending between the midpoints of the bottom wall side edges to define a pair of generally trapezoidal sections, one to each side of said central fold line.

11. The carton of claim 8 wherein said bottom wall includes two partially overlapped sections, one integrally joined to each of said front and rear walls along a corresponding one of said bottom wall end edges.

12. For use in the formation of a food carton of an inverted, truncated conical configuration; a unitary blank, said blank comprising opposed front and rear wall panels aligned along a longitudinal axis of said blank, said panels having spaced facing base edges, a bottom wall panel integral with each of said front and rear wall panels at said base edges and extending therebetween, said bottom panel having a first opposed pair of longitudinally spaced arcuate end edges and a second pair of laterally spaced side edges, said arcuate end edges being defined in said opposed wall panels in inwardly spaced relation to the corresponding base edges thereof, the base edge of each panel extending laterally beyond said bottom panel to form a pair of opposed base edge end portions, said front and rear wall panels each having an outer edge in spaced opposed relation to the corresponding base edge, said front and rear walls each having opposed side edges extending between the corresponding base edge and outer edge, said outer edge of said front panel being concave, said outer edge of said rear panel being convex, a central fold defined in said bottom panel centrally between said base edges and extending between said bottom panel side edges, and a pair of opposed side fold lines defined in said bottom panel respectively in inwardly spaced generally parallel relation to the spaced side edges of the bottom panel and forming a pair of foldable side segments on said bottom panel, and adjacent each side edge.

13. The carton blank of claim 12 wherein each bottom panel side edge and the corresponding fold line are of generally arcuate configurations.

14. The carton blank of claim 13 wherein each bottom panel side edge is generally convex and defined by two generally equal length linear extents meeting at an angle at said central fold line.

15. The carton blank of claim 14 including a pair of glue flaps integral with and extending along the length of the opposed side edges of one of said front and rear wall panels.

16. The carton blank of claim 15 wherein said opposed side edges of each of said front and rear wall panels diverge outwardly from each other from the corresponding base edge to the corresponding outer edge to define a generally truncated triangular configuration for each wall panel.

17. The carton blank of claim 16 wherein said base edges of said front and rear panels are of equal length.

* * * * *